US006568585B2

(12) United States Patent
Marie

(10) Patent No.: US 6,568,585 B2
(45) Date of Patent: May 27, 2003

(54) CARTON AND CARTON BLANK

(75) Inventor: Philippe Marie, Coings (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/068,562

(22) Filed: Feb. 6, 2002

(65) Prior Publication Data

US 2002/0100708 A1 Aug. 1, 2002

Related U.S. Application Data

(63) Continuation of application No. PCT/US00/21479, filed on Aug. 7, 2000.

(51) Int. Cl.[7] ..... B65D 65/22

(52) U.S. Cl. ..... 229/103.2; 206/427; 206/434; 206/784

(58) Field of Search ..... 229/103.2; 206/427, 206/429, 431, 434, 476, 477, 565, 784

(56) References Cited

U.S. PATENT DOCUMENTS

| | | | | |
|---|---|---|---|---|
| 2,828,008 A | | 3/1958 | Fryburger | 206/196 |
| 2,929,497 A | * | 3/1960 | Million-Czarnecki | 206/427 |
| 3,155,232 A | | 11/1964 | Leone | 206/476 |
| 3,366,305 A | | 1/1968 | Cohen et al. | 206/562 |
| 3,385,502 A | * | 5/1968 | Pilger | 206/784 |
| 3,688,972 A | * | 9/1972 | Mahon | 206/427 |
| 3,847,282 A | * | 11/1974 | Collura et al. | 206/476 |
| 3,913,739 A | | 10/1975 | Hennessey | 206/434 |
| 3,918,583 A | | 11/1975 | Adams | 206/491 |
| 4,674,633 A | * | 6/1987 | Steadman | 229/103.2 |
| 4,728,025 A | * | 3/1988 | Oliff | 229/103.2 |
| 4,732,316 A | * | 3/1988 | Oliff et al. | 229/103.2 |
| 5,163,548 A | | 11/1992 | Domansky | 206/158 |
| 5,197,657 A | * | 3/1993 | Cassidy et al. | 229/103.2 |
| 5,297,673 A | | 3/1994 | Sutherland | 206/147 |
| 5,348,218 A | * | 9/1994 | Haire et al. | 206/565 |

FOREIGN PATENT DOCUMENTS

| | | |
|---|---|---|
| CA | 980304 | 12/1975 |
| EP | 0 133 957 | 3/1985 |
| FR | 1 435 991 | 3/1966 |
| FR | 1 436 066 | 3/1966 |
| FR | 2 369 165 | 5/1978 |
| FR | 2 659 624 | 9/1991 |
| GB | 1 589 533 | 5/1981 |

* cited by examiner

*Primary Examiner*—Gary E. Elkins
(74) *Attorney, Agent, or Firm*—Tsugihiko Suzuki

(57) ABSTRACT

An article carrier and a blank for an article carrier for holding an article, for example a tray, comprising a top wall, opposed side walls and a base wall hingedly connected together to form a tubular structure and wherein there further comprises an article retention structure hingedly connected to the top wall and the base panel. The article retention structure is formed by a pair of interconnected panels formed from adjacent carton walls and inwardly folded to retain the article within the carrier.

7 Claims, 8 Drawing Sheets

CARTON AND CARTON BLANK

This is a continuation of international application No. PCT/US00/21479, filed Aug. 7, 2000, which is hereby incorporated by reference.

BACKGROUND OF THE INVENTION

This invention relates generally to a carton having an article retention feature and more particularly to a wrap-around type article carrier designed for articles such as connected plastic cups containing yogurt or other similar foodstuff.

The prior art illustrates wraparound cartons with end closure panels for closing the ends of the carton that are connected to respective side and base panels by a series of gusset panels that assist in forming the end closure panels. There are many arrangements of gusset panels, examples of which are shown in U.S. Pat. No. 5,180,054, FR-A-1 44 536. Prior art structures illustrate carriers for carrying articles with planar sides for example cans or bottles and end retention structures are therefore formed in a planar relationship with respective sides and ends of the corner.

When articles with tapered sides or articles provided with flanges, for example yogurt pots, are packaged in groups or meat trays, there will tend to be relative movement between article(s) and the carrier which is undesirable. Prior art carriers do not provide satisfactory retention for articles of this type.

Another problem associated with the prior art is that the retention structure in some cases tends to collapse within the carrier.

SUMMARY OF THE INVENTION

The present invention and its preferred embodiments seek to overcome or at least mitigate the problems of the prior art.

One aspect of the invention provides an article carrier for holding one or more articles, for example connected plastic cups or a tray, comprising a first wall, opposed side walls and a second wall hingedly connected together to form a tubular structure and wherein there further comprises an article retention structure hingedly connected to said first wall and said second wall. The article retention structure is formed by a pair of interconnected panels formed from adjacent carton walls and inwardly folded to retain the articles within the carton.

Beneficially, the article carrier can be applied to articles with tapered or planar sides where it is desired to provide a retention structure that does not need to be glued.

Preferably, the pair of interconnected panels may include an inwardly folded panel hingedly connected to the first wall to be disposed in face contacting relationship therewith and wherein the other of the interconnected panels is hingedly connected to the second wall.

According to an optional feature of this aspect of the invention the pair of interconnected panels may comprise a gusset panel connected to a side retention panel wherein the gusset panel is hingedly connected to the first wall and is adapted to be placed intermediate the first panel and an article so that the side retention panel is retained in a set up condition. Preferably, there further comprises an anchoring tab for placement between the packaged article and the first wall. More preferably, the anchoring tab projects inwardly of the inwardly folded gusset panel.

According to another optional feature of this aspect of the invention an aperture may be defined between side retention panel and the adjacent side wall and wherein the tab projects inwardly into the aperture beyond the hinged connection between the interconnected panel when in a flat collapsed condition.

According to an optional feature of this aspect of the invention, an inner edge of the side retention panel may be arranged to abut against an article.

According to another optional feature of this aspect of the invention the side retention panel may comprise upper and lower parts hingedly connected together to be temporarily folded out of alignment during construction of the article retention structure to assist with construction of the second wall.

A second aspect of the invention provides an article retention structure for retaining articles within a tubular carton, which article retaining structure may comprise a side retention panel hingedly connected to a side wall, a top gusset panel hingedly connected to a top wall and hingedly connected to the side retention panel. Preferably, there may further comprise an aperture struck from a portion of the side walls, wherein an edge for which aperture tapers inwardly towards the base.

A third aspect of the invention provides a carton blank for forming an article carrier for holding an article for example a tray, comprising a first side panel, a first wall panel, a second side panel and a second wall panel hingedly connected together in series, wherein there further comprises an article retention structure hingedly connected to said first wall panel and said second wall panel. The article retention structure is formed by a plurality of panels including a side retention panel so constructed and arranged to taper inwardly towards said second wall panel to substantially conform to the shape of an adjacent article held in a set up carton.

Preferably, the plurality of panels may further comprise a gusset panel connected to the side retention panel wherein the gusset panel is hingedly connected to the second wall panel and includes a tab adapted to be placed intermediate the second wall panel and an article so that the side retention panel is retained in a set up condition.

More preferably, an aperture may be defined between side retention panel and the adjacent side wall and wherein the tab projects inwardly into the aperture beyond the hinged connection between the gusset panel and side retention panel.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
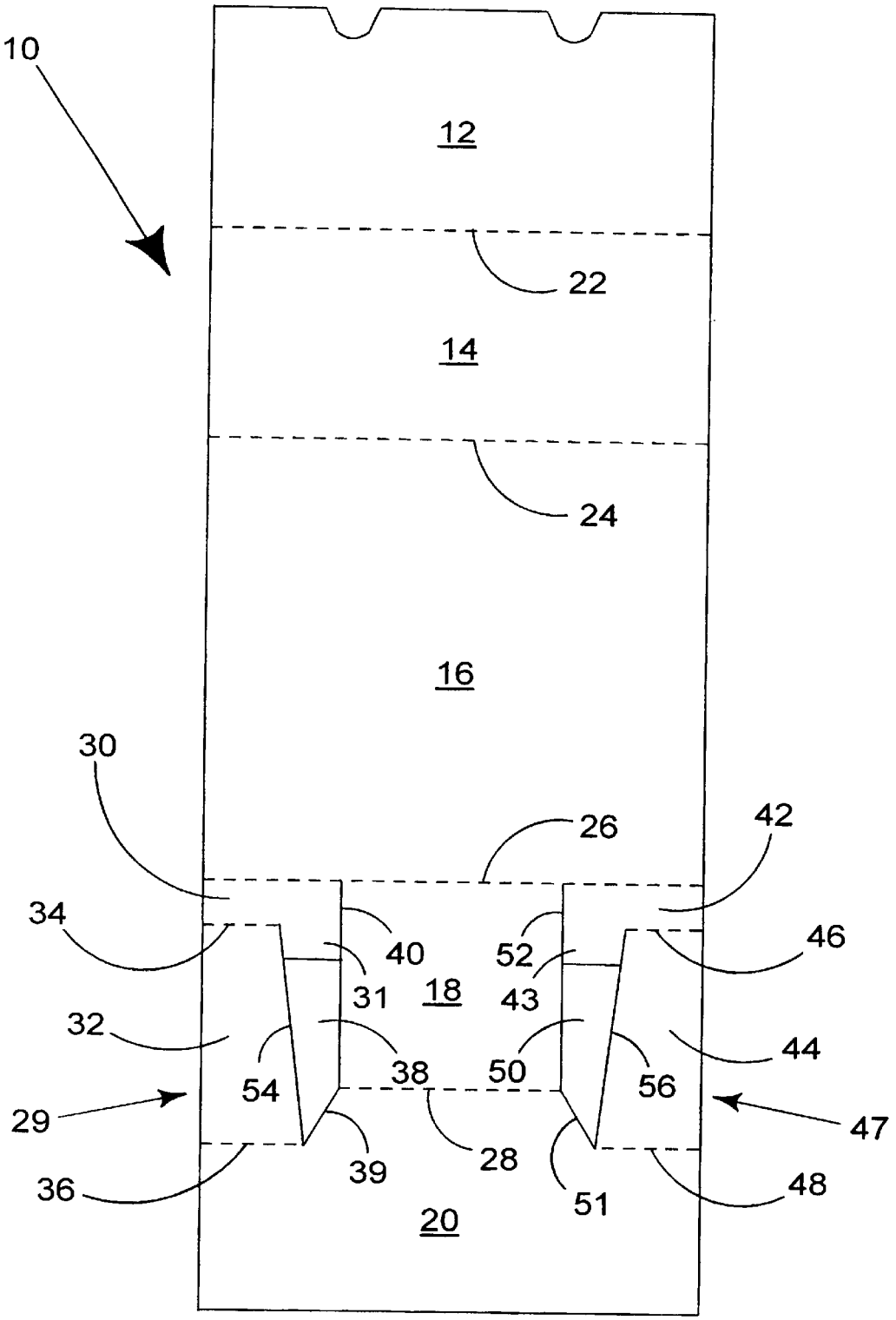
FIG 1. illustrates a blank for forming a carton according to an aspect of the invention.

Referring to the drawings, and in particular FIG. 1, there is shown a carton blank for forming a carton made from paperboard or similar foldable sheet material. In these embodiments, wraparound type cartons can be formed from the blanks. It will be recognized that rather than the bottom wall being formed from the interlocked panels, the carton blank may be rearranged whereby some other wall such as a top wall or a side wall is formed from the interlocked panels.

Turning to the embodiment shown in FIG. 1 the blank 10 comprises a first base panel 12, first side wall panel 14, top panel 16, second side wall panel 18, second base panel 20 hingedly connected one to the next along fold lines 22, 24, 26 and 28 respectively.

A series of panels for forming an article retention structure is provided along one side and end of the carton. The article retention arrangement 29 at one corner of side and base panels 18, 20 comprises an upper gusset panel 30 hingedly connected to top panel 16 along an extension of fold line 26. There further comprises a side retention panel 32 hingedly connected to base panel 20 along fold line 36. Side retention panel 32 and upper gusset panel 30 are interconnected by a fold line 34. In this embodiment, fold lines 26, 34 and 36 are substantially parallel, although the orientation of these fold lines can be altered according to the shape of article to be packaged.

An aperture 38 may be provided which in FIG. 1 is formed intermediate side wall panel 18 and side retention panel 32 and, preferably, extends into base panel 20.

Upper gusset panel 30 is separated from side panel 18 by cut line 40 and it may further comprise a tab portion 31 extending from panel 30 into the aperture 38 beyond fold line 34. In use, tab portion 31 is adapted to project inwardly of the side retention structure 29 to be retained between the top panel 16 and an outer article to retain the side retention panel 32 in a set up condition.

Likewise, the opposing side of base and side wall panels 20 and 18 further comprises a similar article retention arrangement 47 comprising an upper gusset panel 42 hingedly connected to top panel 16 along an extension of fold line 26. There further comprises a side retention panel 44 hingedly connected to base panel 20 along fold line 48. Side retention panel 44 and upper gusset panel 42 are interconnected by a fold line 46.

An aperture 50 may be provided which in FIG. 1 is formed intermediate side wall panel 18 and side retention panel 44 and, preferably, extends into base panel 20.

Upper gusset panel 42 is separated from side panel 18 by cut line 52 and it may further comprise a tab portion 43 extending from panel 42 into the aperture 50 beyond fold line 46. In use, tab portion 43 functions in the same manner as tab portion 31 described above.

In one class of embodiments, the lower edge 39, 51 of the apertures 38, 50 may diverge away from a point of intersection with fold line 28 to define an obtuse angle with fold line 28, thereby to define a protruding portion of the base in a set up condition. Optionally, the inner edges 54, 55 of side retention panels 32, 44 may taper inwardly or otherwise conform to the shape of the articles with respect to a notional vertical plane and/or correspond to the difference in distance between the bottom of the cup and the top flange of the cup.

Figure 6:
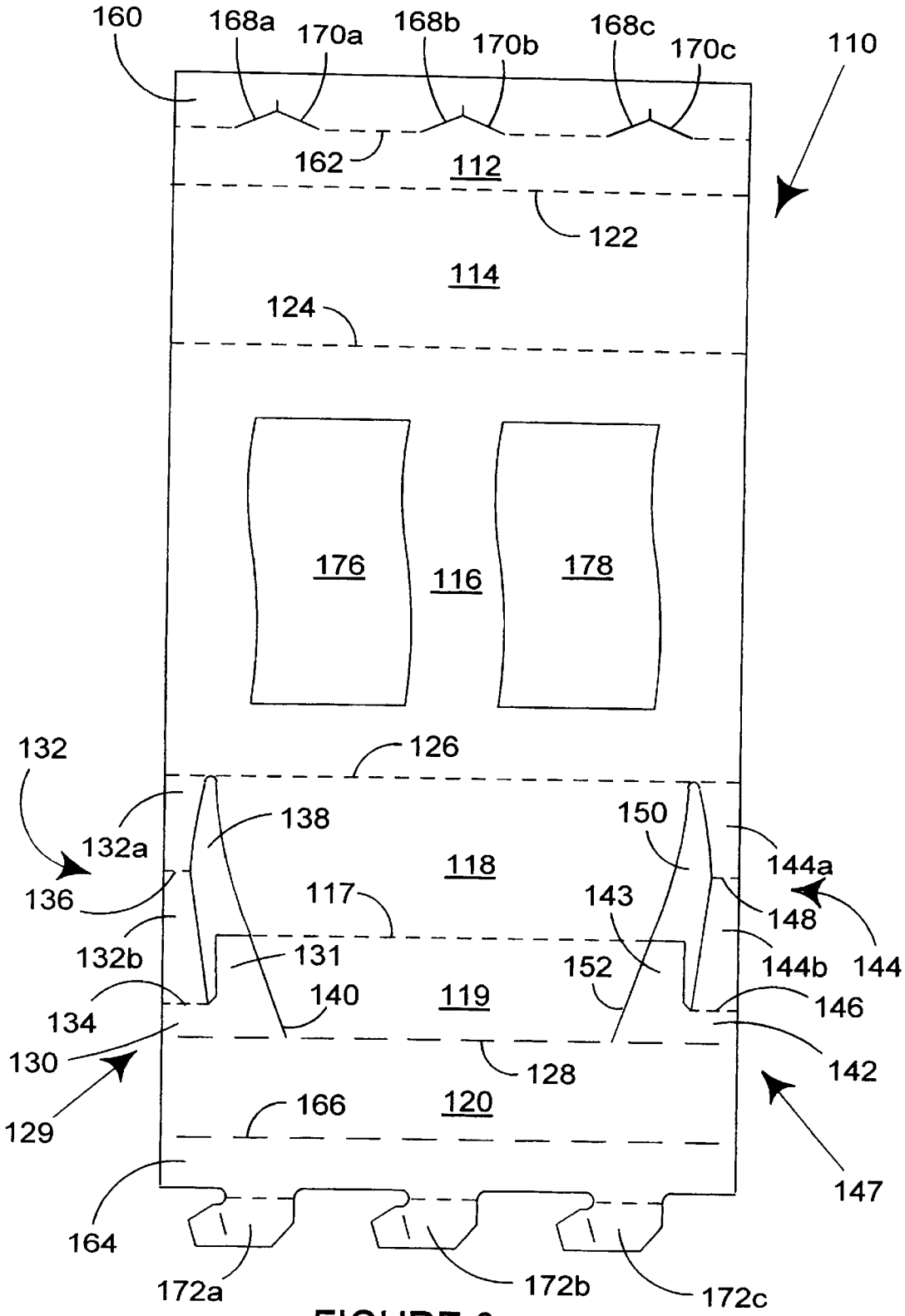
FIG. 6 illustrates a blank for forming a carton according to a second embodiment of the invention.

A second embodiment shown in FIG. 6 is adapted to package meat trays. The blank 110 comprises a first base panel 112, first side wall panel 114, top panel 116, second side wall panel 118, outer base panel 119 and inner base panel 120 hingedly connected one to the next along fold lines 122, 124, 126, 117 and 128 respectively.

A series of panels for forming one or more article retention structures 129, 147 is provided along one side and end of the carton. Preferably, the article retention arrangement 129 is positioned at one end of side wall panel 118 and inner and outer base panels 119, 120. The article retention arrangement 129 comprises a pair of interconnected panels including an inwardly folded panel hingedly connected to the base wall to be disposed in face contacting relationship therewith and wherein the other of the interconnected panels is hingedly connected to the top wall.

It will be seen from FIG. 6 that the pair of interconnected panels comprise a gusset panel 130 hingedly connected to outer base panel 120 along an extension of fold line 128. There further comprises a side retention panel 132 hingedly connected to top panel 116 along an extension of fold line 126. Side retention panel 132 and gusset panel 130 are interconnected by a fold line 134.

Preferably, side retention panel 132 comprises upper and lower parts 132*a* and 132*b* hingedly interconnected along fold line 136.

An aperture 138 may be provided, which in FIG. 6 is formed intermediate side panel 118 and side retention panel 132 and may extend adjacent to inner base panel 119.

Figure 11:
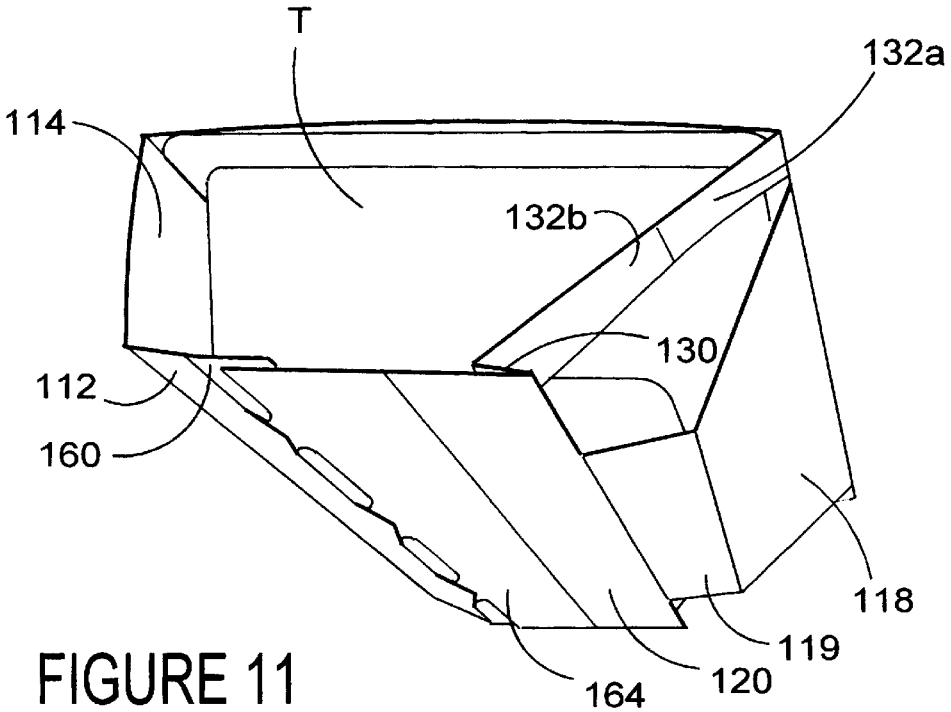
FIGS. 11 and 12 illustrate the carton loaded with an article formed from the blank of FIG. 6.

Preferably, gusset panel 130 is separated from inner base panel 119 by cut line 140 and it may further comprise a tab portion 131 extending from gusset panel 130 into the aperture 138 beyond fold line 134. In use, tab portion 131 is adapted to project inwardly of the side retention panel to be retained between the base panel 120 and the article T to retain the side retention panel 132 in a set up condition, shown in FIG. 11.

Likewise, the opposing end of inner and outer base panels 119, 120 and side wall panel 118 further comprises a similar article retention arrangement 147 comprising a gusset panel 142 hingedly connected to base panel 120 along an extension of fold line 128. There may further comprise a "two part" side retention panel 144*a* and 144*b* hingedly connected to top panel 116 along fold line 126. Side retention panel 144 and gusset panel 142 are interconnected by a fold line 146.

An aperture 150 may be provided which is preferably formed intermediate side panel 118 and side retention panel 144 and may extend adjacent to inner base panel 119.

Similarly, gusset panel 142 is separated from side panel 118 by cut line 152 and it may further comprise a tab portion 143 extending from panel 142 into the aperture 150 beyond fold line 146. In use, tab portion 143 also projects inwardly of the side retention panel 144 to be retained between the outer base panel 120 and the article T to retain the side retention panel 144 in a set up condition.

The blank may further comprise securing means for securing together the opposed ends of the blank to form a wraparound carton. In this embodiment, the securing means comprises a pair of support panels 160 and 164 extending beyond the ends of base panels 112 and 120 and hingedly connected thereto along fold line 162 and interrupted fold line 166 respectively. In use, the support panels form a two ply structure to provide additional support where the panels engage, which is commonly the weakest part of the carton. The securing means of this embodiment further comprises a locking arrangement comprising a plurality of locking tabs 172*a*, 172*b* and 172*c* extending outwardly from support panel 164. There also comprises corresponding apertures for receiving the locking tabs which are defined by cut lines 168*a*, 170*a*, 168*b*, 170*b* and 168*c*, 170*c* extending substantially along interrupted fold line 162. It is envisaged that other known securing means could be used, for example glue or other locking arrangements without departing from the scope of invention.

In one class of embodiments, there further comprises one or more display windows to view the contents of the article contained in the carrier. In this embodiment, there comprises two display windows 176 and 178 struck from top panel 116.

Turning to the construction of the carton from a carton blank as illustrated in FIGS. 1 and 6, the blanks 10 or 110 require a series of sequential folding and gluing operations which is preferably performed in a straight line machine so that the carton is not required to be rotated or inverted to complete its construction. The folding process is not limited to that described below and can be altered according to particular manufacturing requirements.

As the carton blank of the first embodiment is moved forward continuously, it is constructed in the manner shown in FIGS. 2 to 5 and is applied to an array of articles A, for example four articles A arranged in a two by two formation, whereby the top panel 16 is supported by the tops of the articles.

Figure 2:
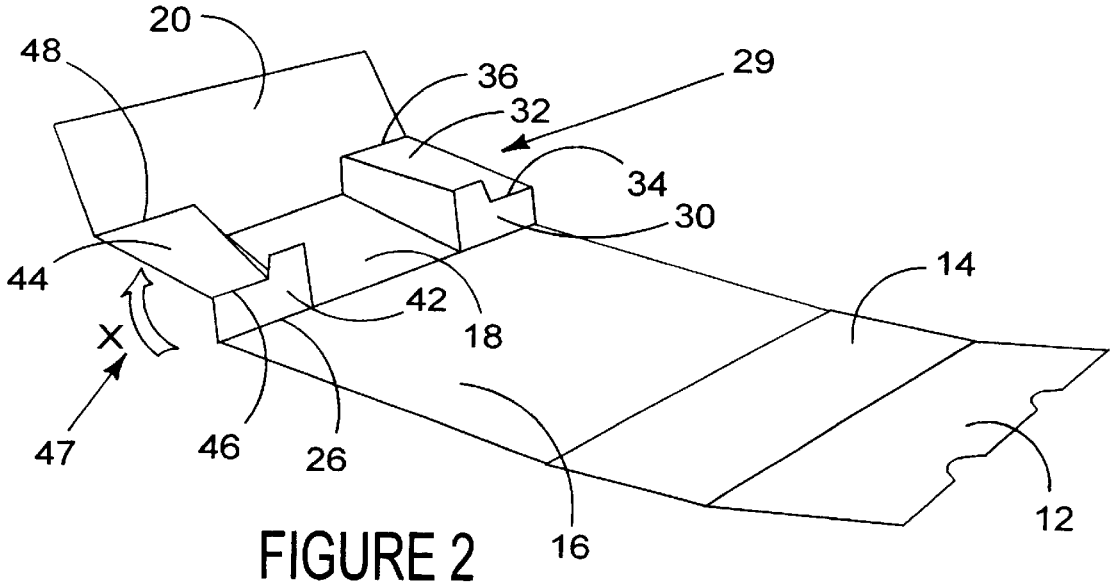
FIGS. 2, 3 and 4 illustrate the carton during the different stages of construction from the blank shown in FIG. 1.

The first stage is shown in FIG. 2 whereby the side panel 18 is folded out of alignment with top panel 16 along fold line 26 and base panel 20 is folded out of alignment with side panel 16 along fold line 28 so that side and base panel 18 and 20 are folded inwardly in direction X. As side panel 18 and base panel 20 are folded the construction of the article retention structures 29, 47, described below, may take place, automatically.

Each article retention structure is formed in a substantially like manner so only the construction of article retention structure 29 will now be described. It is usual for the retention structures on a blank to be formed at substantially the same time by a suitable arrangement of guides and/or locating means.

Figure 3:
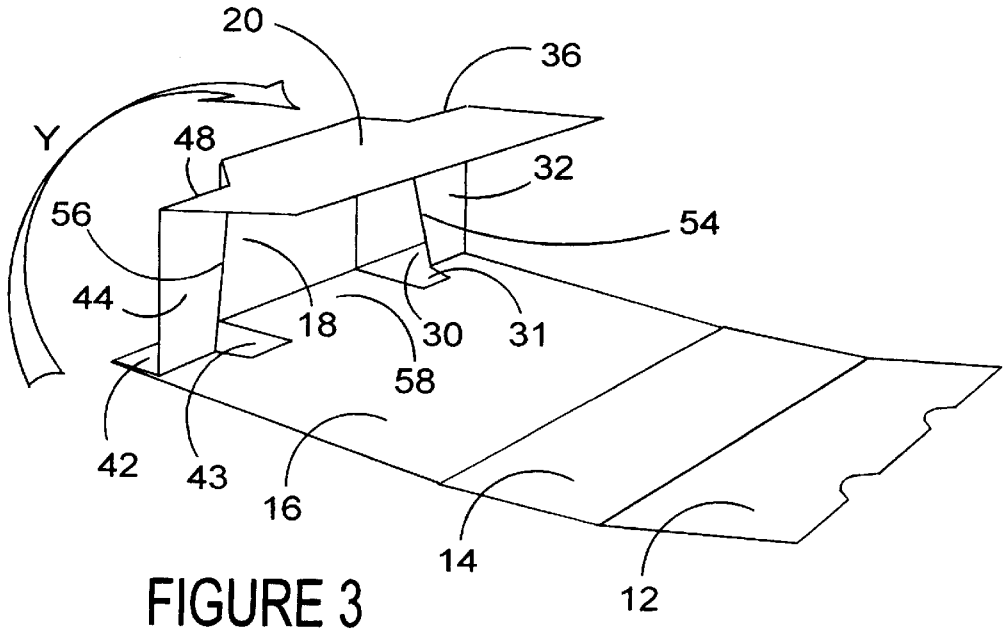

Thus, article retention structure 29 is formed by, first, folding upper gusset panel 30 about fold line 26 such that it is folded into face contacting relationship with top panel 16 shown in FIGS. 2 and 3.

As upper gusset panel 30 is folded inwards in direction Y (FIG. 3) towards top panel 16, it is folded out of alignment with side retention panel 32 along fold line 34 into a substantially perpendicular relationship which causes the side retention panel 32 to be moved out of alignment along fold line 36 with side wall panel 18 and into an angular relationship with base panel 20. Thus, the side retention panel 32 may be caused to taper inwardly towards the base panel 20, as shown in FIG. 3. Optionally the upper gusset panel 30, and in those embodiments with tab 31 can be secured to the top panel 16 by glue or other suitable means known in the art.

The opposing article retention structure 47 is formed in a similar manner, as shown in FIGS. 2 and 3.

Figure 4:
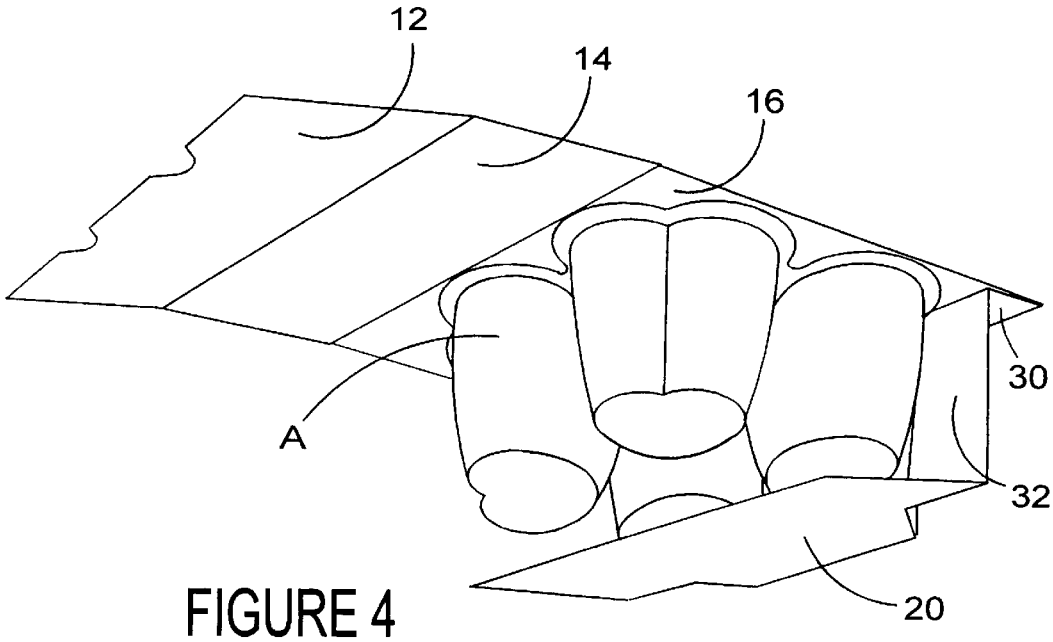

The articles A are then loaded into the carrier from the side or from the end by suitable packaging machinery with the tabs 31, 43 positioned between the top of the adjacent articles and the inner face of the top panel, shown in FIG. 4. The articles are held in place by abutment with the inner edges 54, 56 of panels 32 and 44. The shape of the base panel 20 allows articles to be placed in the protruding portion 58 of base panel 20, adjacent side wall panel 18.

Figure 5:
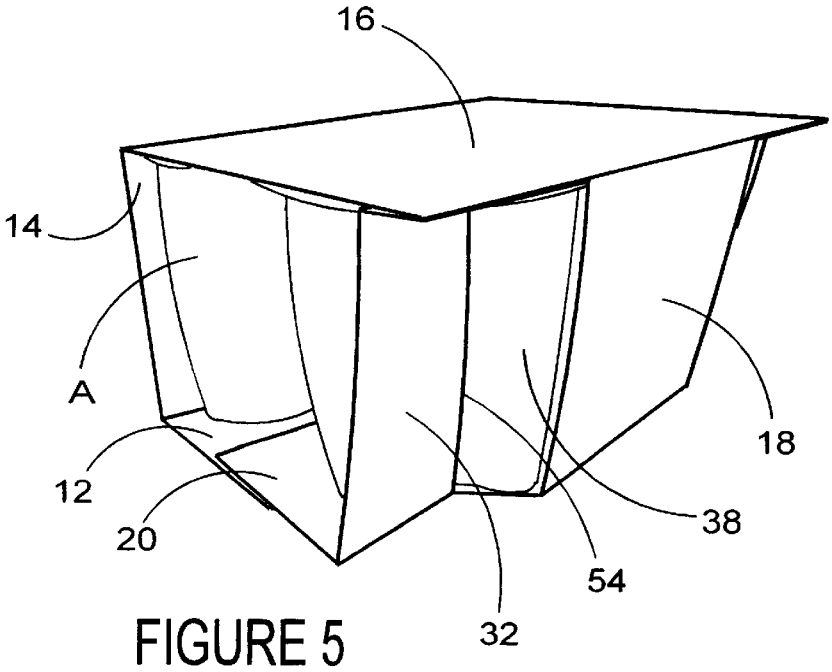
FIG. 5 illustrates the carton loaded with articles formed from the blank of FIG. 1.

Thereafter, the folding of base and side wall panels 12, 14 is completed by folding these panels along fold lines 22 and 24 respectively so that a portion of base panel 12 is placed in face contacting relationship with a corresponding overlapping portion of base panel 20 and is secured together to form a base structure, by glue or other means known in the art as illustrated in FIG. 5. Thus, the carton is in a fully erected and loaded condition.

FIG. 5 illustrates a carton formed from a blank of the first embodiment shown in FIG. 1. More particularly, there is illustrated an article carrier for holding articles with tapered sides, for example connected plastic cups, comprising a top wall 16, opposed side walls 14, 18 and a base 12, 20 hingedly connected together to form a tubular structure and wherein there further comprises an article retention structure 29, 47 hingedly connected to one of said side walls 14 and said base 12. The article retention structure is formed by a pair of interconnected panels formed from adjacent carton walls and inwardly folded to retain the articles within the carton.

Beneficially, the articles are held in place by the article retention structures, to prevent unwanted removal. The retention structures are prevented from collapsing by the tabs 31, 43 being engaged between the articles A and the top panel 16.

The carton blank 110 of the second embodiment is constructed in a similar manner to the first embodiment, whereby it is moved forward continuously as it is constructed in the manner shown in FIGS. 7 to 11. It is applied to an article T, for example a tray, whereby the top panel 116 is supported by the top of the article.

Figure 7:
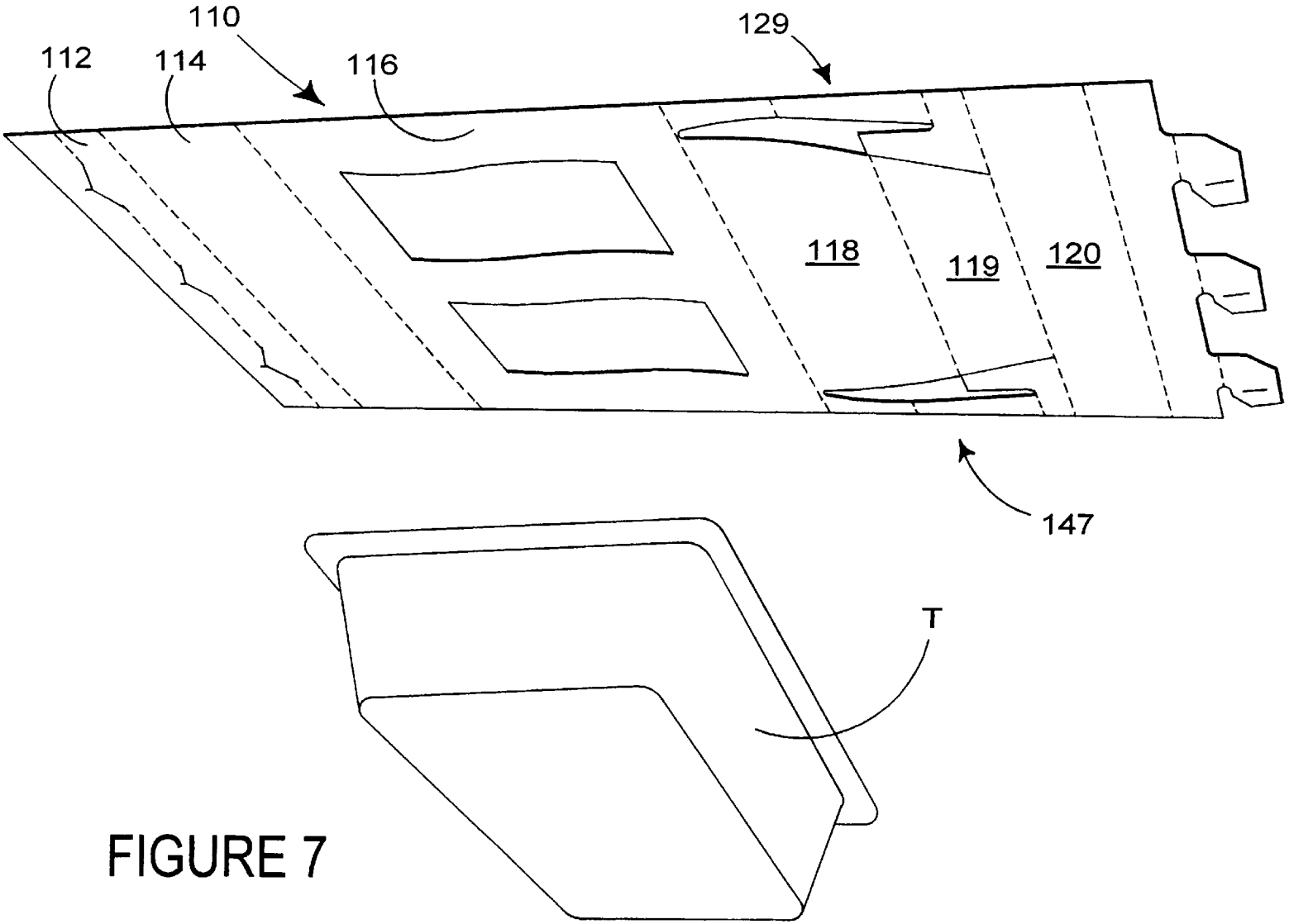
FIGS. 7, 8, 9 and 10 illustrate the carton during the stages of construction from the blank shown in FIG. 1.
Figure 8:
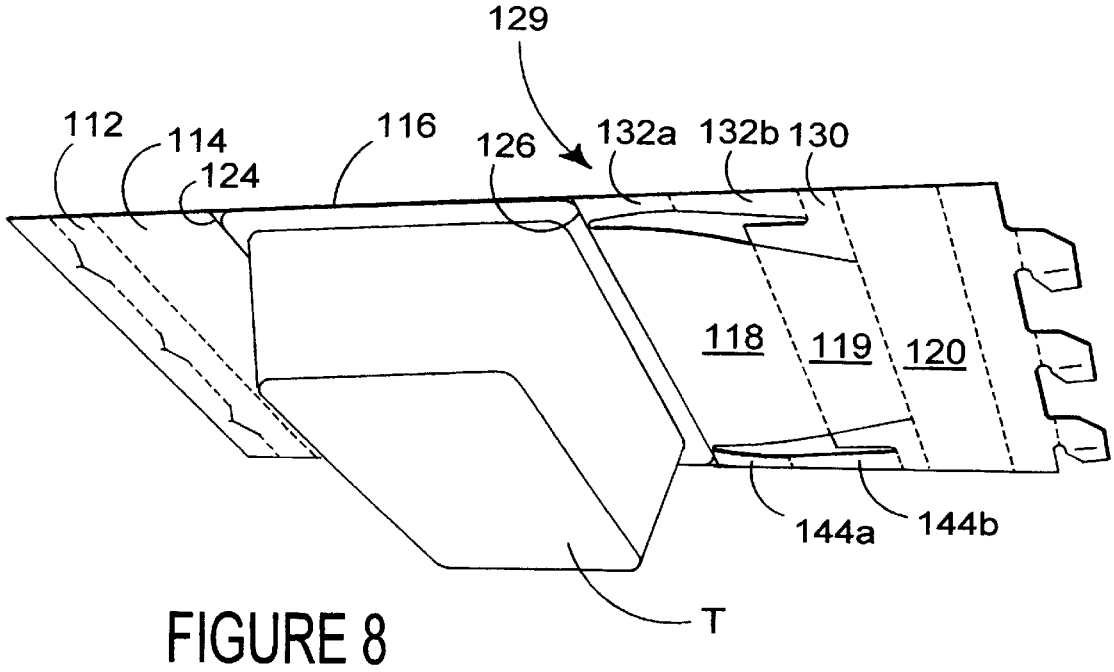

The first stage of construction is shown in FIGS. 7 and 8 whereby the top panel 116 is brought into contact with the top of the tray T. Thereafter, side panels 114 and 118 are folded out of alignment with top panel 116 along fold lines 124 and 126 respectively to wraparound the article. Outer base panel 120 is folded out of alignment with inner base panel 119 along fold line 128, shown in FIG. 9, so that base panel 120 is folded outwardly in direction X. As side panel 118 and outer base panel 120 are folded the construction of the article retention structures occurs, described in more detail below.

Each article retention structure is formed in a like manner so only the construction of article retention structure 129 will now be described. It is usual for the retention structures on a blank to be formed at substantially the same time by a suitable arrangement of guides and/or locating means.

Thus, article retention structure 129 is formed by, first, folding gusset panel 130 inwardly about fold line 134. In one class of embodiments, this is achieved automatically when the outer base panel 120 is folded out of alignment with inner base panel 119.

Figure 9:
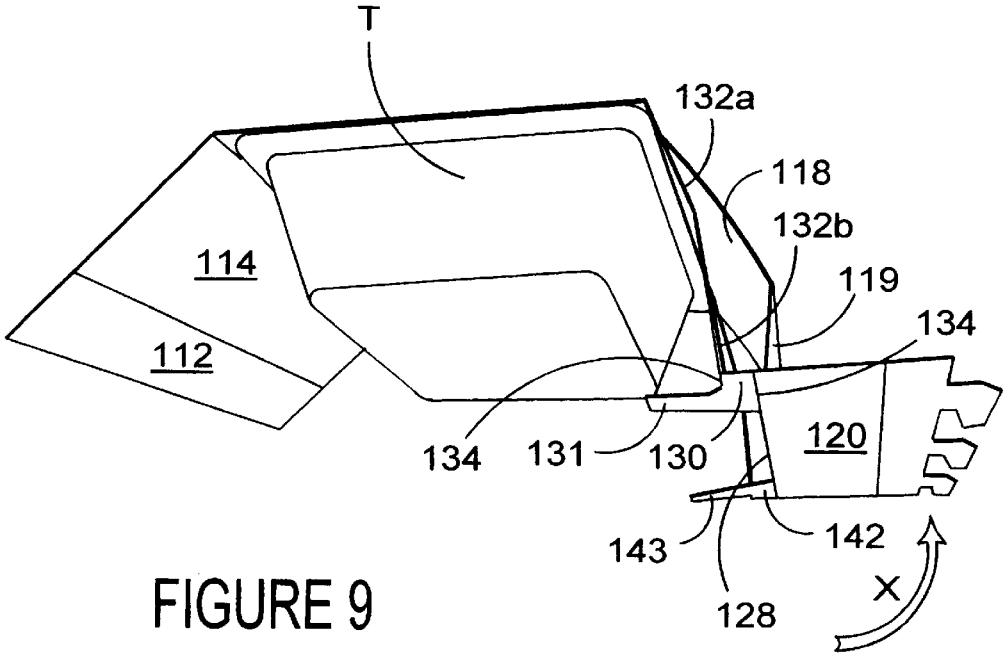

This folding action is illustrated in FIG. 9 and it will be seen that as gusset panel 130 is folded inwardly, it is also folded out of alignment with side retention panel 132 along fold line 134 into a substantially perpendicular relationship. Also, side retention panel 132 is caused to be moved out of alignment with side panel 118 and into an angular relationship with top panel 116 along fold line 126. Thus, the side retention panel 132 may be caused to taper inwardly with respect to side panel 118 because fold lines 128 and 134 are offset, in the vertical plane.

Thereafter, inner base panel 119 is folded out of alignment with side panel 118 along fold line 117 and side retention panels 132*a* and 132*b* are caused to be folded out of alignment along fold line 136.

The opposing article retention structure 147 is formed in a similar manner, as shown in FIGS. 7, 8 and 9.

Figure 10:
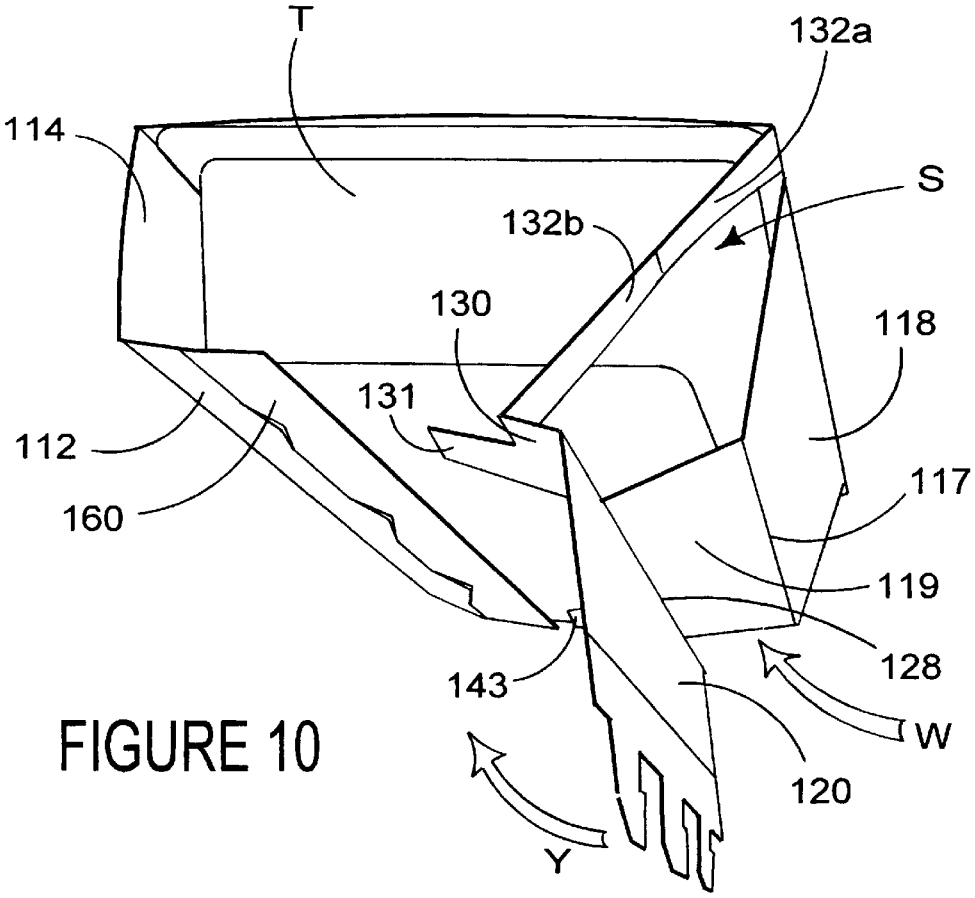

As the side panels 114, 118 continue to be folded towards the sides of article T, inner base panel 119 is folded inwardly in direction W, shown in FIG. 10, which increases the spacing between the side retention panel 132 and side wall panel 118. Base panel 119 is folded into abutment with the base of the article T along fold line 117 and outer base panel

120 is folded towards gusset panels 130 and 142 in direction Y along fold line 128 into face contacting relationship with gusset panels 130, 142 and tabs 131, 142. At this stage of the construction, side retention panels 132 and 144 are thus positioned across the end face of the carton to prevent the tray from sliding out of either end of the carton.

Optionally gusset panel 130, and in those embodiments with tab 131, can be secured to the top panel 116 by glue or other suitable means known in the art.

Base panels 112, 120 are secured together by suitable means known in the art, whereby the locking tabs 172 are inserted through the slits 168, 170 to be engaged therewith. The shoulder portions are engaged by the abutment with securing panel 160 shown in FIG. 11.

Figure 12:
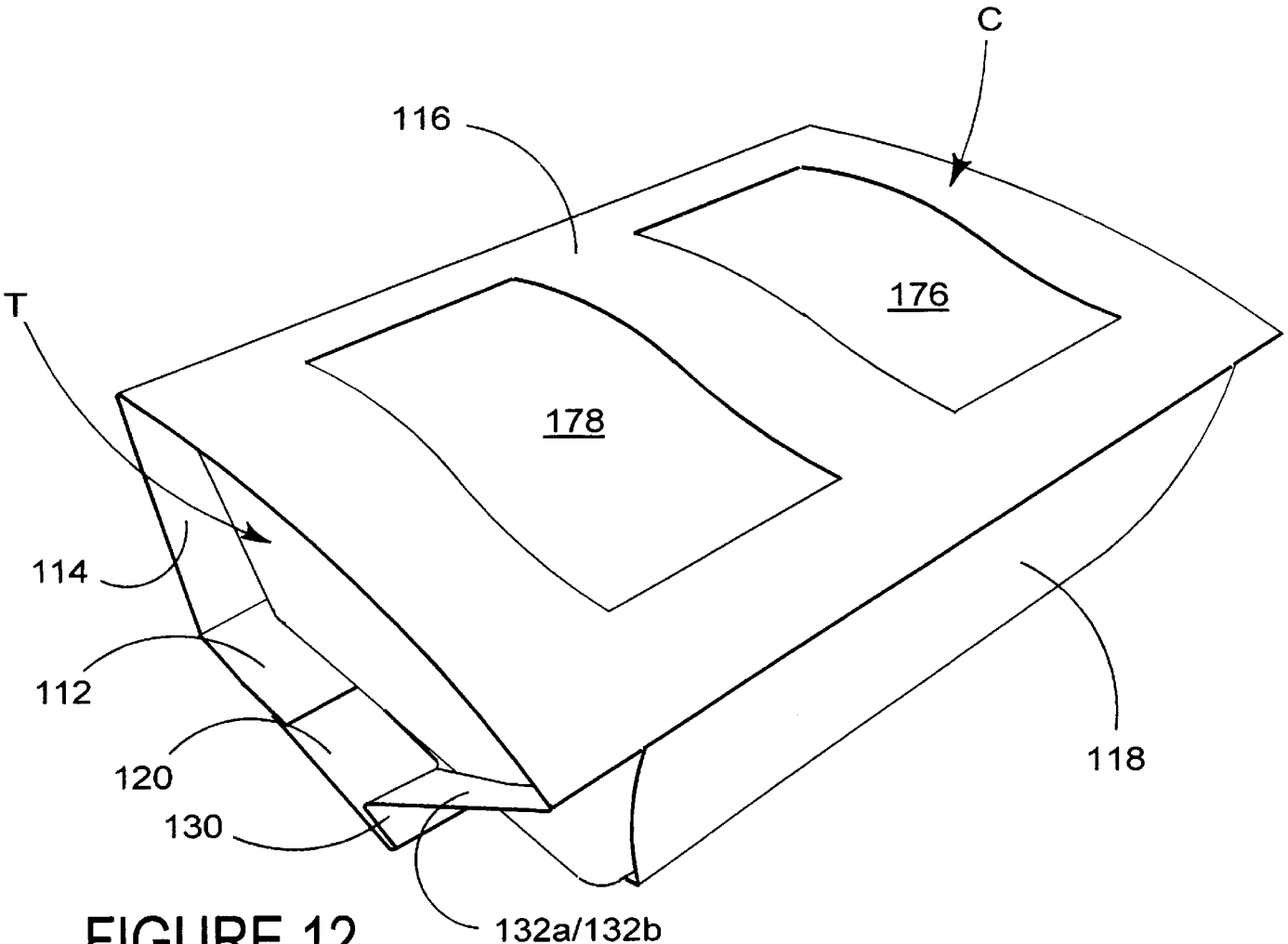

Thus, the article carrier is in a set up and erected condition as shown in FIG. 12 in which there comprises a top wall 116, opposed side walls 114, 118 and a base wall 120, 112 hingedly connected together to form a tubular structure and wherein there further comprises an article retention structure hingedly connected to said top wall and said base wall. The article retention structure is formed by a pair of interconnected panels 130, 132 formed from adjacent carton walls and inwardly folded to retain the article within the carton.

The article T is held in place by abutment with the inner edges of side retention panels 132 and 144 to prevent unwanted removal.

It will be seen from FIG. 12 that gusset panels 130, 142 and/or tabs 131, 143 are positioned between the bottom of the article T and the inner face of base panel 120 to prevent the retention structures from collapsing.

It will also be recognised that as used herein, directional references such as "top", "base", "end", "side", "inner" and "outer" do not limit the respective panels to such orientation, but merely serve to distinguish these panels one from another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and its preferred embodiment relates to an article carrier that is shaped to provide satisfactory strength to hold articles securely, but with a degree of flexibility so that during transit the articles are retained within the carrier. The shape of the blank minimises the amount of paperboard required and the carrier can be applied to an array of articles by hand or automatic machinery. It is anticipated that the invention can be applied to a variety of carriers and is not limited to those of the wrap-around type hereinabove described. Further or alternatively, the carton may be adapted to carry a greater or lesser number of articles without departing from the scope of the invention.

What is claimed is:

1. An article carrier for holding at least one article, comprising a first wall, opposed side walls, a second wall hingedly connected together to form a tubular structure and an article retention structure hingedly connected to said first wall and said second wall, wherein said article retention structure is formed by a pair of interconnected panels formed from adjacent ones of said first, second and side walls and inwardly folded to retain said at least one article within said tubular structure, wherein said pair of interconnected panels comprises a gusset panel and a side retention panel hingedly connected together, and wherein said gusset panel is hingedly connected to said first wall along a first fold line extending inwardly from one of opposed ends of said tubular structure, and said gusset panel is folded inwardly along said first fold line to be in face contacting relationship with said first wall and includes a part that is adapted to be placed intermediate said first wall and said at least one article so that said side retention panel is retained in a set up position.

2. An article carrier as claimed in claim 1 wherein said side retention panel is hingedly connected to said second wall along a second fold line extending inwardly from said one end of said tubular structure, said first and second fold lines being parallel to each other.

3. An article carrier according to claim 1 wherein said gusset panel includes a tab portion projecting inwardly of said tubular structure beyond a hinged connected between said gusset panel and said side retention panel.

4. An article carrier as claimed in claim 1 wherein an inner edge of said side retention panel is arranged to abut against said at least one article.

5. An article carrier as claimed in claim 1 wherein said side retention panel comprises upper and lower parts hingedly connected together to be temporarily folded out of alignment during construction of said article retention structure to assist with construction of said second wall.

6. An article carrier for holding at least one article, comprising a first wall, opposed side walls, a second wall hingedly connected together to form a tubular structure and an article retention structure hingedly connected to said first wall and said second wall, wherein said article retention structure is formed by a pair of interconnected panels formed from adjacent ones of said first, second and side walls and inwardly folded to retain said at least one article within said tubular structure, wherein said pair of interconnected panels comprises a gusset panel and a side retention panel hingedly connected together, and wherein said gusset panel is hingedly connected to said first wall and includes a part that is adapted to be placed intermediate said first wall and said at least one article so that said side retention panel is retained in a set up position, wherein said gusset panel includes a tab portion extending inwardly of said tubular structure from said gusset panel to be placed between said at least one article and said first wall, wherein an aperture is defined between said side retention panel and an adjacent one of said side walls, and wherein said tab portion projects inwardly into said aperture beyond a hinged connected between said gusset panel and said side retention panel when the carrier is in a flat collapsed condition.

7. A carton blank for forming an article carrier for holding at least one article, comprising a first side panel, a first wall panel, a second side panel and a second wall panel hingedly connected together in series, and an article retention structure hingedly connected to said first wall panel and said second wall panel, wherein said article retention structure is formed by a plurality of panels including a side retention panel so constructed and arranged to taper inwardly towards said second wall panel to substantially conform to the shape of said at least one article held in a set up carton, wherein said plurality of panels comprises a gusset panel hingedly connected to said side retention panel, said gusset panel being hingedly connected to said second wall panel and including a part adapted to be placed intermediate said second wall panel and said at least one article so that said side retention panel is retained in a set up position, and wherein an aperture is defined between said side retention panel and an adjacent one of said first and second side wall panels, and wherein said gusset panel includes a tab portion projecting inwardly into said aperture beyond a hinged connection between said gusset panel and said side retention panel.

* * * * *